US010780014B2

(12) United States Patent
Dunbar

(10) Patent No.: US 10,780,014 B2
(45) Date of Patent: Sep. 22, 2020

(54) WALKER MOBILITY ARRANGEMENT

(71) Applicant: Wayne E. Dunbar, Newburyport, MA (US)

(72) Inventor: Wayne E. Dunbar, Newburyport, MA (US)

( * ) Notice: Subject to any disclaimer, the term of this patent is extended or adjusted under 35 U.S.C. 154(b) by 0 days.

(21) Appl. No.: 16/350,225

(22) Filed: Oct. 16, 2018

(65) Prior Publication Data

US 2020/0000672 A1 Jan. 2, 2020

Related U.S. Application Data

(60) Provisional application No. 62/707,004, filed on Oct. 16, 2017.

(51) Int. Cl.
*A61H 3/04* (2006.01)
*A61H 3/00* (2006.01)

(52) U.S. Cl.
CPC ..... *A61H 3/04* (2013.01); *A61H 3/008* (2013.01); *A61H 2201/1633* (2013.01); *A61H 2201/1652* (2013.01); *A61H 2203/0431* (2013.01)

(58) Field of Classification Search
CPC .... A61H 2201/1633; A61H 2203/0481; A61H 2203/0487
USPC ..... 135/67, 74
See application file for complete search history.

(56) References Cited

U.S. PATENT DOCUMENTS 4,342,465 A * 8/1982 Stillings ..... A61H 3/04 135/67
4,941,708 A * 7/1990 Heffner ..... A61G 7/1015 135/67
4,953,851 A * 9/1990 Sherlock ..... A61H 3/04 237/6
5,255,697 A * 10/1993 Grauer ..... A61H 3/04 135/67
5,271,422 A * 12/1993 Sorrell ..... A61H 3/04 135/66
5,380,262 A * 1/1995 Austin ..... A61H 3/04 280/647
5,443,304 A * 8/1995 Fochs ..... A61H 3/04 135/67
5,813,948 A * 9/1998 Quigg ..... A61H 3/04 280/87.041
5,904,168 A * 5/1999 Alulyan ..... A61H 3/00 135/65
6,595,530 B2 * 7/2003 Wood ..... A61H 3/04 280/42

(Continued)

*Primary Examiner* — David R Dunn
*Assistant Examiner* — Danielle Jackson
(74) *Attorney, Agent, or Firm* — Don Halgren

(57) ABSTRACT

A four sided mobile walker arrangement to enable the safe movable support and confinement of a handicapped patient therewithin. The walker arrangement comprises a rearmost backside frame connected by an intermediate left rear corner column to a left side frame, and is connected to a right side frame by an intermediate right rear corner column. The right side frame is connected to a front side gate by an intermediate right front column. A planar rear seat portion attached to an inner side of the rearmost backside frame and a planar front seat portion attached to an inner side of the front side gate, to define a rigid planar support to enable a patient within the mobile walker assembly to sit or stand and walk therewithin.

16 Claims, 9 Drawing Sheets

(56) References Cited

U.S. PATENT DOCUMENTS

| | | | | |
|---|---|---|---|---|
| 7,461,891 | B1 * | 12/2008 | Andersen | A47D 1/0085 297/44 |
| 8,522,907 | B1 * | 9/2013 | Irvine | A61G 5/128 135/66 |
| 8,584,689 | B2 * | 11/2013 | Catton | A61H 3/04 135/67 |
| 8,720,914 | B1 * | 5/2014 | Heath | A61H 3/04 135/67 |
| 8,944,458 | B1 * | 2/2015 | Ferez | A61H 3/04 135/67 |
| 9,278,042 | B2 * | 3/2016 | Osterhaus | A61H 3/04 |
| 9,895,283 | B1 * | 2/2018 | Gimblet | A61H 3/04 |
| 2005/0183759 | A1 * | 8/2005 | Wolfe | A61H 3/04 135/67 |
| 2007/0199586 | A1 * | 8/2007 | Cheng | A61H 3/04 135/67 |
| 2014/0296039 | A1 * | 10/2014 | Shaw | A61H 3/04 482/68 |
| 2018/0133094 | A1 * | 5/2018 | Helfer | A61H 3/04 |
| 2019/0192374 | A1 * | 6/2019 | Lass | A61G 5/1002 |

* cited by examiner

WALKER MOBILITY ARRANGEMENT

FIELD OF THE INVENTION

This invention relates to patient support devices and more particularly to framed walker-arrangements to assist relatively immobile individuals in standing and walking, and is based upon my U.S. Provisional Application No. 62/707,004, filed 16 Oct. 2017, which is incorporated herein by reference in its entirety.

DISCUSSION OF THE BACKGROUND OF THE INVENTION

Patient-assist devices are in common use today in hospitals, nursing homes and in convalescent activities. Physical therapists are called upon in many of these instances to treat patient's pains, muscles and joints. Further, patient's dignity and confidence needs to be built for long-lasting results. The ability to get a patient self lifted into a vertical orientation is desirable as it permits and encourages mobility and blood circulation. Current walkers may often require several nurses or physical assistance personnel to enable a single patient to walk at all before they will gain any sense of mobility for their rehabilitation.

It is an object of the present invention to overcome the disadvantages of the prior art.

It is a further object of the present invention to enable a disabled or relatively immobile adult individual to become mobile and vertical and have at least limited control over his or her physical movement and capabilities.

It is thus an object of the present invention to provide a portable, articulable, adjustable, foldably collapsible, mobile, single-patient support assembly to enable an otherwise mobility-restricted patient to be moved into and supported into a comfortable seat supported condition, if necessary, for seated or standing self-guided perambulation.

It is still another object of the present invention to enable comfortable and stable mobility to a patient who may need variation of height positioning than may be typically required.

It is yet a still further object of the present invention to provide an assist device capable of use with minimal help or assistance.

BRIEF SUMMARY OF THE INVENTION

The present invention comprises a walker assembly for use in assisting immobile or disabled patients to move about in a walking-like manner with basic control over their movement and with minimal assistance.

The walker assembly has a generally rectilinear rear frame side, a generally rectilinear left frame side with a curved patient grip-able uppermost frame member, a generally rectilinear right frame side with a curved patient grip-able uppermost frame member and a front side gate which is hingedly attached to a frontmost column preferably on the right frame side. The left frame side is preferably hingedly attached to a left rear column of the rectilinear rear side of the walker assembly. The right frame side is preferably hingedly attached to a right rear column of the rectilinear rear side of the walker assembly.

The left frame side has a lower truss extending between the left rear column and the left front column. The left frame side has an intermediate truss extending between the left rear column and the left front column. The curved uppermost frame member of the left frame side is comprised of removable and displaceable tubular portions which intermate with one another to permit customizable curved gripping portions thereof along for use in support of a particular sized individual. The curved uppermost frame member on the right frame side is similarly and correspondingly comprised of removable and displaceable tubular portions which intermate with one another to permit corresponding customizable curved patient gripping portions thereof along for use in support of a particular sized individual.

The generally rectilinear rear frame side has a lower truss extending between the left rear column and the right rear column. The rear frame side also has an intermediate truss extending between the left rear column and the right rear column. An uppermost arrangement of tubular members extends between the left rear column and is the right rear column to further structurally define the rectilinear rear frame.

A generally planar rigid rear seat has an elongated rearmost edge which is hingedly attached to the intermediate truss extending between the left rear column and the right rear column. The rigid rear seat has a left edge which rests upon the intermediate truss extending between the left rear column and the right front column of the left frame side. The rigid rear seat has a right edge which correspondingly rests upon the intermediate truss extending between the right rear column and the right front column of the right frame side. The rigid rear seat has a forward edge extending generally into the mid-portion of the walker assembly, when the seat is in its lowermost patient supporting orientation, the forward edge having a curvilinear shape of a sine wave. The apex of the sine wave configuration is disposed at the midpoint of the transverse width of the rigid rear seat. The rigid rear seat is hingedly movable from a supported horizontal orientation resting on the intermediate left and right side trusses into a vertical orientation resting against the uppermost arrangement of tubular members connecting the uppermost portions of the left rear column and the right rear column, to help facilitate collapsing of the frame portions of the walker assembly for storage purposes described further hereinbelow.

The front gate has a lower gate truss and a spaced apart intermediate gate truss each extending between a first end member of the front gate and a respective connecting hinge pivotally secured to the right front column. A generally planar rigid front seat has an elongated frontmost edge which is hingedly attached to the intermediate gate truss extending between the first end member and its respective hinge pivotally secured to the right front column. The rigid front seat has a left edge which rests upon the intermediate left side truss extending between the left rear column and the left front column when the front gate is in its closed orientation. The rigid front seat has a right edge which rests upon the intermediate right side truss extending between the right rear column and the right front column when the front gate assistance closed orientation. The rigid front seat has a rearwardly facing edge extending into the (near) mid-portion of the walker assembly when the rigid front seat is in its lowermost patient supporting orientation. The rigid front seat has a rearwardly facing edge having a curvilinear sine wave configuration. The apex of the sine wave configuration is disposed at the midpoint of the transverse width of the rigid front seat. The apex of the rearwardly facing edge of the rigid front seat and the apex of the forwardly facing edge of the rigid rear seat are slightly spaced apart from one another when the front seat and the rear seat are in a horizontal patient (sitting) supporting orientation. The open spaces on either side of the apexes of the rigid front seat and the rigid rear seat provided the locus for a patient's legs therewithin. The front gate has a sleeve above the hinge attaching the front gate to the right front column. The sleeve is curved and has an upper end with a front gate grab handle. The front gate has a grab handle on the upper end of the left end rail. The left end rail member is of "C' shape in cross-section and mates against the left front column on the front gate is closed. The left end rail has locking members which engage corresponding locking members spaced apart on the left front column.

A further embodiment of the present invention comprises the front side gate which is split into twin halves, having a split right side gate pivotally connected by a plurality of hinges, to the right front column, and a split left side gate pivotally connected by a plurality of hinges to the left front column. The split right side gate has a split right front seat, splitting the apex of that curvilinear form at its midpoint. The split left side gate is a split left front seat splitting the apex of the curvilinear form and its midpoint, comprising a mirror image of its adjacent split right side front seat. The split left front seat and the split right front seat are pivotable upwardly into a vertical orientation about a plurality of hinges attached to a left gate truss and a right gate truss respectively. The split left front seat has a left edge which rests upon the intermediate left side truss and the split right front has a right edge which rests upon the intermediate right side truss. The split left side gate and the split right side gate each have a latchable column which are securely engageable with one another by a latch, when both gates are closed.

A yet further embodiment of the present invention comprises a rigid seating arrangement including a planar seat supported at each side thereof by a pair of flexible straps, each flexible strap attached at its upper end to the uppermost frame portions of the left side and right side respectively of the left frame side and the front frame side. Each flexible strap has its upper end preferably arranged through a wind/unwind ratchet to accommodate changes as needed to the length of the particular seat supportive strap.

A still yet further soft support embodiment of the present invention includes a centrally supportive flexible web seat, of somewhat "X" shape, having four corners each of which have a flexible belt connected thereto. Each belt has a distal end with a clasp thereattached. The right rear column and the left rear column each have a height adjustable clamp thereon. The right front column and the left front column also each have an adjustable clamp thereon. Each clamp may include a belt length adjusting ratchet to facilitate fine-tuning of the length of those belts. A user of the soft support embodiment of the present invention is able to attach one belt to the respective adjustable clamps on the right rear column and the left rear column. That user of the soft support embodiment of the present invention will be able to rotate the rigid front seat upwardly into a vertical out-of-the-way orientation and, once that user is within the confines of the walker assembly, attach the remaining two flexible belts from between his/her legs and through the proper respective adjustable clamps on the right front column and the left front column. It is further contemplated that the rigid front seat may be readily removable by lifting that rigid front seat off of a releasable (bayonet style) hinge arranged on the front side gate. This soft seat embodiment of the present invention provides the user the option of utilizing a pair of rigid front and back support seats or no rigid support seats and just the flexible support web or the back rigid support seat and the flexible support web therewith.

A lockable swivel wheel is arranged at the lowermost end of the left rear column, the right rear column, the left front column and the right front column to enable the walker assembly to be walked in any direction by a patient sitting on the seat portions, or standing with his/her legs through the open spaces between the sine wave configurations.

The invention thus comprises a rectilinear walker assembly having a first or rear side, a second or left side, a third or right side, and a front-gate side, each connected to a vertically adjustable corner column, wherein the rear side has a rigid rear seat hingedly thereattached to permit the rigid rear seat to be moved from a horizontal orientation to a walker storable vertical orientation, wherein the front gate side has/may have a front rigid seat hingedly there-attached to permit the rigid front seat to be moved from a horizontal orientation to a walker storable vertical orientation, and wherein the rigid rear seat has a forwardly directed edge of sinusoidal configuration and wherein the rigid front seat has a rearwardly directed edge of sinusoidal configuration. The rearwardly directed edge of the rigid front seat in the forwardly directed edge of the rigid rear seat each have an apex on their opposed sinusoidal edges which are slightly non-interferably spaced apart from one another when the rigid front seat and the rigid rear seat are in a horizontal orientation. The first or rear frame side and the second or left frame side are hingedly connected to one another. The third or right frame side is hingedly connected to the first or rear side. The front-gate-side is hingedly connected to the third or right side, to permit compact-folding of the walker assembly.

The front gate side may be split into a left side and a right side. The rigid front seat may be split transversely at its apex, each half being carried by its respective gate side. The left side and the right side each have intermediate side trusses extending between their respective corner columns. Each rigid front seat and rigid rear seat have side edges which rest upon their intermediate side trusses when the rigid front seat and the rigid rear seat are in the horizontal patient supporting orientation. The sinusoidal front facing and sinusoidal rear facing seat configurations define a patient's leg-positioning-locus for receipt of a patient's legs on the respective opposite sides (left and right) of the opposed apexes. The second or left side is foldable about a backside of the first or rear side, the third or right side is foldable about a front side of the first or rear side, and the front gate side is folded about an outer side of the third or right side of the assembly. The front gate may have a left column of "C" shape in cross-section, arranged to closely engage and partially surround the left side front corner column.

The invention also comprises a four sided mobile walker arrangement to enable the safe movable support and confinement of a handicapped patient therewithin, comprising: a rearmost backside frame connected by an intermediate left rear column to a left side frame, and connected to a right side frame by an intermediate right rear column, the right side frame connected to a front-side gate by an intermediate right front column; and a planar rear seat portion attached to an inner side of the rearmost backside frame and a planar front seat portion attached to an inner side (when closed) of the front side gate, to define a rigid planar support there between, to enable a patient within the mobile walker assembly to sit or stand therewithin. The planar rear seat portion is hingedly attached to an inner side of the rearmost backside frame to permit the planar rear seat portion to be moved from a horizontal orientation to a vertical orientation, and the planar front seat portion is hingedly attached the front side gate to permit the planar front seat portion to be moved from a horizontal orientation to a vertical orientation, to enable the four sided mobile walker arrangement side portions to be folded closely adjacent/against the rearmost backside frame. The intermediate left rear column is hingedly connected to the left side frame, and the intermediate right rear column is hingedly connected to the right side frame, and the intermediate right front column is hingedly connected to the front side gate. The planar rear seat portion has a frontmost facing edge in the shape of a sinusoidal wave, and the planar front seat portion has a rearmost facing edge the shape of a sinusoidal wave. Each sinusoidal wave of the seat portions has a centrally disposed apex, and each centrally disposed apex is spaced apart from one another when the planar rear seat portion and the planar front seat portion are in their horizontal orientations. The rearmost backside frame, the left side frame and the right side frame are constructed of intermating segments to enable dimensional replacement and thus size adjustability thereof. The planar rear seat portion and the planar front seat portion each have side edges which are arranged to rest upon trusses between their respective adjacent columns.

The invention also comprises a four sided mobile walker arrangement to enable the safe movable support and confinement of a handicapped patient therewithin, comprising: a rearmost backside frame connected by an intermediate left rear column to a left side frame, and connected to a right side frame by an intermediate right rear column, the right side frame connected to a front-side gate by an intermediate right front column; a rigid planar rear seat portion attached to an inner side of the rear most backside frame; and a height adjustable clamp and attached ratchet secured to the right rear column, the left rear column, the right front column and the left front column; a flexible web seat having an arrangement of elongated flexible belts extending from corners thereof, each of the belts having a clasp on their distalmost end for securement to their respective height adjustable clamp and ratchet, to enable a patient a support option to utilize a rigid planar seat together with a soft support web extending between the front and rear columns of the walker assembly.

BRIEF DESCRIPTION OF THE DRAWINGS

The objects and advantages of the present invention will become more apparent when viewed in conjunction with the following drawings, in which.

DETAILED DESCRIPTION OF THE DRAWINGS

Figure 1:
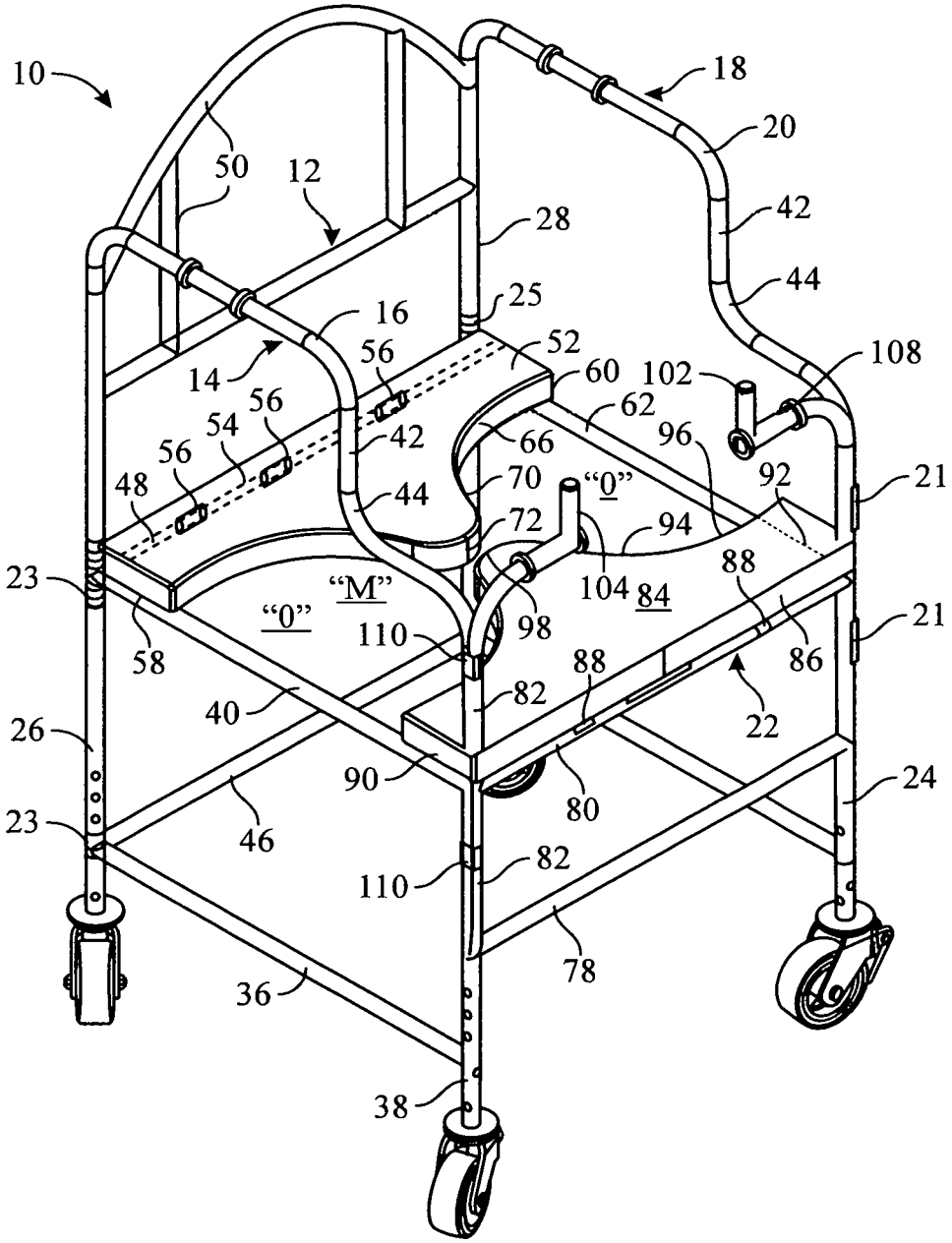
FIG. 1 is a perspective view of a walker assembly having a single front gate, the assembly constructed according to the principles of the present invention.

Referring now to the drawings in detail, and particularly to FIG. 1, present invention shown comprises a walker assembly 10 for use in assisting immobile or disabled patients to move about in a walking-like manner with basic control over their movement and with minimal assistance.

The walker assembly 10 has a generally rectilinear rear frame side 12, a generally rectilinear left frame side 14 with a curved uppermost frame member 16, a generally rectilinear right frame side 18 with a curved uppermost frame member 20 and a front side gate 22 which is hingedly attached by a plurality of hinges 21 to a front right column 24 on the right frame side 18. The left frame side 14 is hingedly attached to a left rear column 26 of the rectilinear rear side 12 of the walker assembly 10 by a plurality of angle lockable hinges 23. The right frame side 18 is hingedly attached to a right rear column 28 of the rectilinear rear side 12 of the walker assembly 10 by angle lockable hinges 25.

The left frame side 14 has a lower truss 36 extending between the left rear column 26 and the left front column 38. The left frame side 14 has an intermediate truss 40 extending between the left rear column 26 and the left front column 38. The curved uppermost frame member 16 of the left frame side 14 is comprised of, for example, a plurality of removable and displaceable tubular portions 42, 44, which intermate with one another for example, in a tightenable male/female manner to permit customizable grippable curved portions thereof for use in support of a particular sized individual, as may be seen in FIGS. 1 thru 5. The curved uppermost frame member 20 on the right frame side 18 is similarly and correspondingly comprised of removable and displaceable tubular portions 42 and 44 which intermate with one another to permit corresponding customizable curved portions thereof along for use in gripped support of a particular sized individual.

The generally rectilinear rear frame side 12 has a lower truss 46 extending between the left rear column 26 and the right rear column 28. The rear frame side 12 also has an intermediate truss 48 extending between the left rear column 26 and the right rear column 28. An uppermost arrangement of tubular members 50 extends between the left rear column 26 and is the right rear column 28 to further structurally define the generally rectilinear rear frame 12.

Figure 2A:
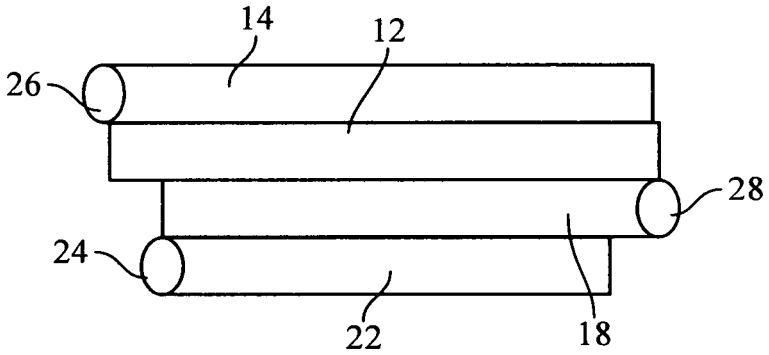
FIG. 2A is a plan view of the walker assembly shown in FIG. 2 with the side and front portions thereof folded about and adjacent the rear frame side.
Figure 2:
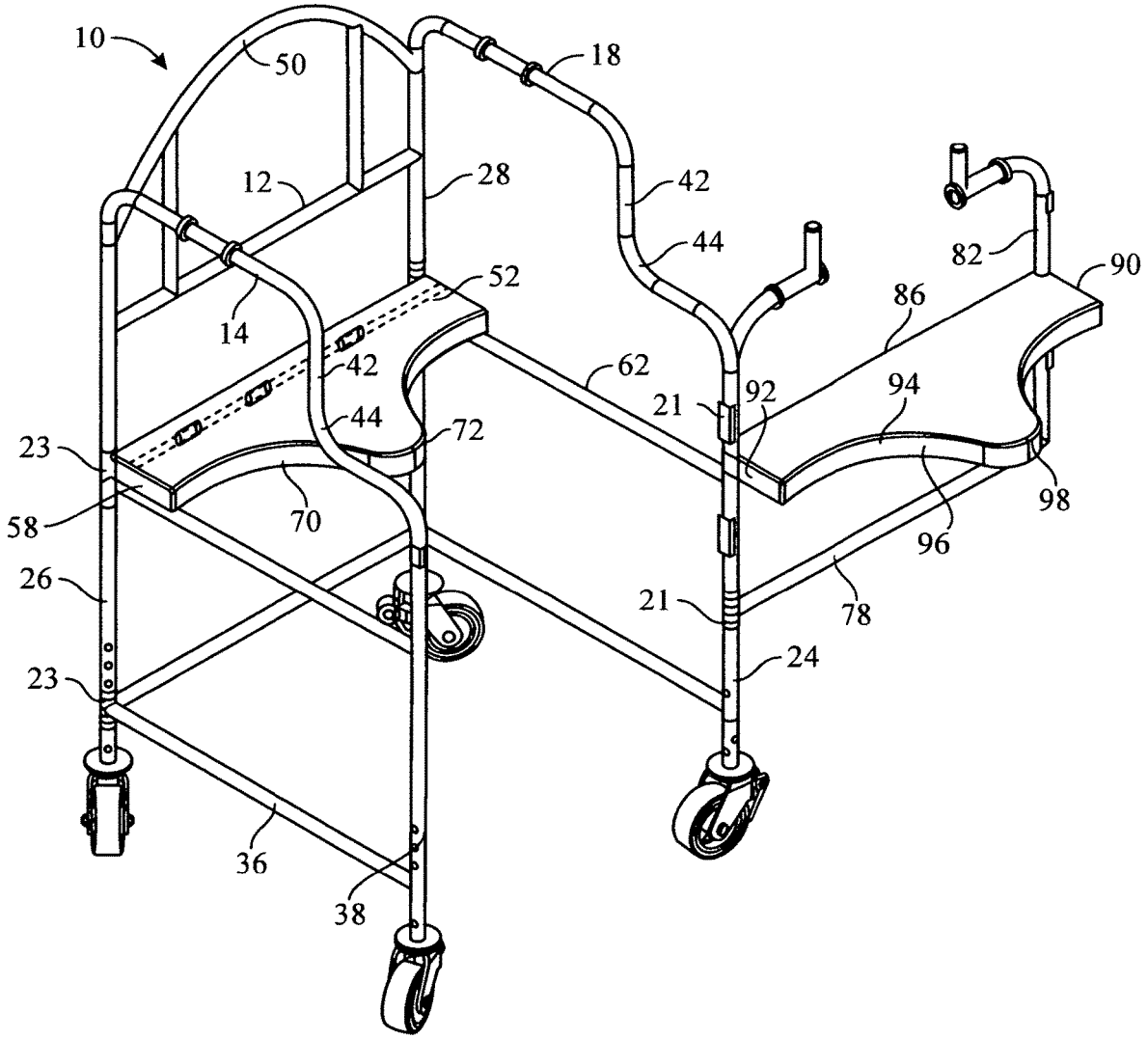
FIG. 2 is a perspective view of the walker assembly shown in FIG. 1, wherein the front gate has been swung open 180°.

A generally planar rigid rear seat 52 has an elongated rearmost edge 54 which is hingedly attached by a plurality of hinges 56 to the intermediate truss 48 extending between the left rear column 26 and the right rear column 28. The rigid rear seat 52 has a left edge 58 which rests upon the intermediate truss 40 extending between the left rear column 26 and the left front column 38 of the left frame side 14. The rigid rear seat 52 has a right edge 60 which correspondingly rests upon the intermediate truss 62 extending between the right rear column 28 and the right front column 24 of the right frame side 18. The rigid rear seat 52 has a forward edge 66 extending generally into the mid-portion of the walker assembly 10, as shown in FIGS. 1 and 2, when the rigid rear seat 52 is in its lowermost person supporting orientation, the forward edge 66 having a curvilinear shape of a sine wave 96 when viewed from above. The apex 72 of the sine wave 70 configuration is disposed at the midpoint of the transverse width of the rigid rear seat 52. The rigid rear seat 52 is hingedly movable, as represented by arrows "A" in FIGS. 1 and 5, from a supported horizontal orientation, best represented in FIG. 5, resting on the intermediate left and right side trusses 40 and 62 respectively, movable into a vertical orientation represented in phantom in FIG. 5, as shown by arrow "A, resting against the uppermost arrangement of tubular members 50 connecting the uppermost portions of the left rear column 26 and the right rear column 28, to help facilitate collapsing of the frame portions 12, 14, 16 and 18 of the walker assembly 10, as represented in FIG. 2A, for storage purposes described further hereinbelow.

The front gate has a lower gate truss 78 and a spaced apart intermediate gate truss 80 each extending between a first end member 82 of the front gate 22 and respective connecting hinges 21 pivotally secured to the right front column 24. A generally planar rigid front seat 84 has an elongated frontmost edge 86 which is hingedly attached by a hinge arrangement 88 to the intermediate gate truss 80 extending between the first end member 82 and its respective hinge arrangement 21 pivotally secured to the right front column 24. The rigid front seat 84 has a left edge 90 which rests upon the intermediate left side truss 40 extending between the left rear column 26 and the left front column 38 when the front gate 22 is in its closed orientation, as shown in FIG. 1, the front gate 22 being shown in its open orientation in FIG. 2. The rigid front seat 84 has a right edge 92 which rests upon the intermediate right side truss 62 extending between the right rear column 28 and the right front column 24 when the front gate is in its closed orientation, as shown in FIG. 1. The rigid front seat 84 has a rearwardly facing edge 94 extending into the mid-portion "M" of the walker assembly 10, as represented in FIG. 1, when the rigid front seat 84 is in its lowermost person supporting orientation. The rigid front seat has a rearwardly facing edge 94 having a curvilinear sine wave 96 shape, as shown in FIGS. 1 and 2. The apex 98 of the curvilinear sine wave 96 is disposed at the midpoint of the transverse width of the rigid front seat 84, as may be seen in FIG. 2. The apex 98 of the rearwardly facing edge 94 of the rigid front seat 84 and the apex 72 of the forwardly facing sine wave shaped edge 70 of the rigid rear seat 52 are slightly spaced apart from one another when the front seat 84 and the rear seat 52 are in a horizontal person-supporting orientation, as may be seen in FIG. 1. The openings "O" on either side of the apexes 72 and 98 between the rigid front seat 84 and the rigid rear seat 52 provided the situs for a patient's legs therewithin.

Figure 1A:
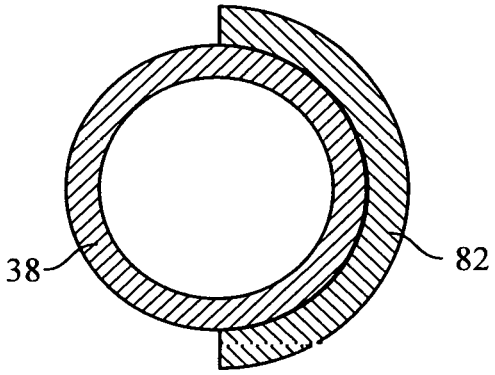
FIG. 1A is a sectional view taken along the lines 1A-1A of FIG. 1.

The front gate 22 has a sleeve 108 above the hinge 21 attaching the front gate 22 to the right front column 24. The sleeve 108 is curved and has an upper end with a front gate grab handle 102. The front gate 22 has a grab handle 104 on the upper shape in cross-section, as shown in FIG. 1A and mates against the left front column 38 when the front gate 22 is closed. The first end member, also called the left end rail 82 has locking members 110 which engage corresponding locking members spaced apart on the left front column 38.

Figure 3:
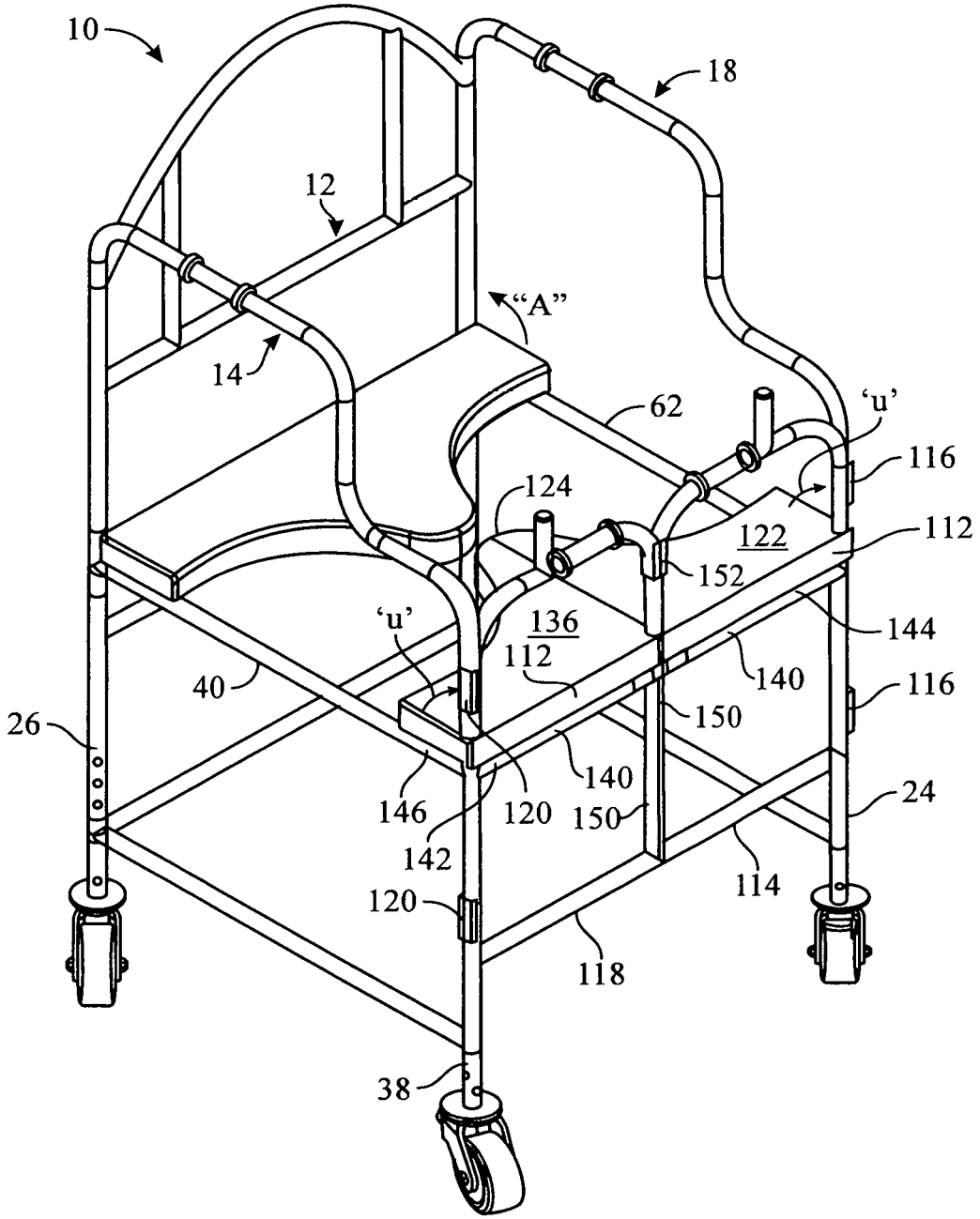
FIG. 3 is a perspective view of the walker assembly of the present invention having a dual front gate arrangement thereon.
Figure 4:
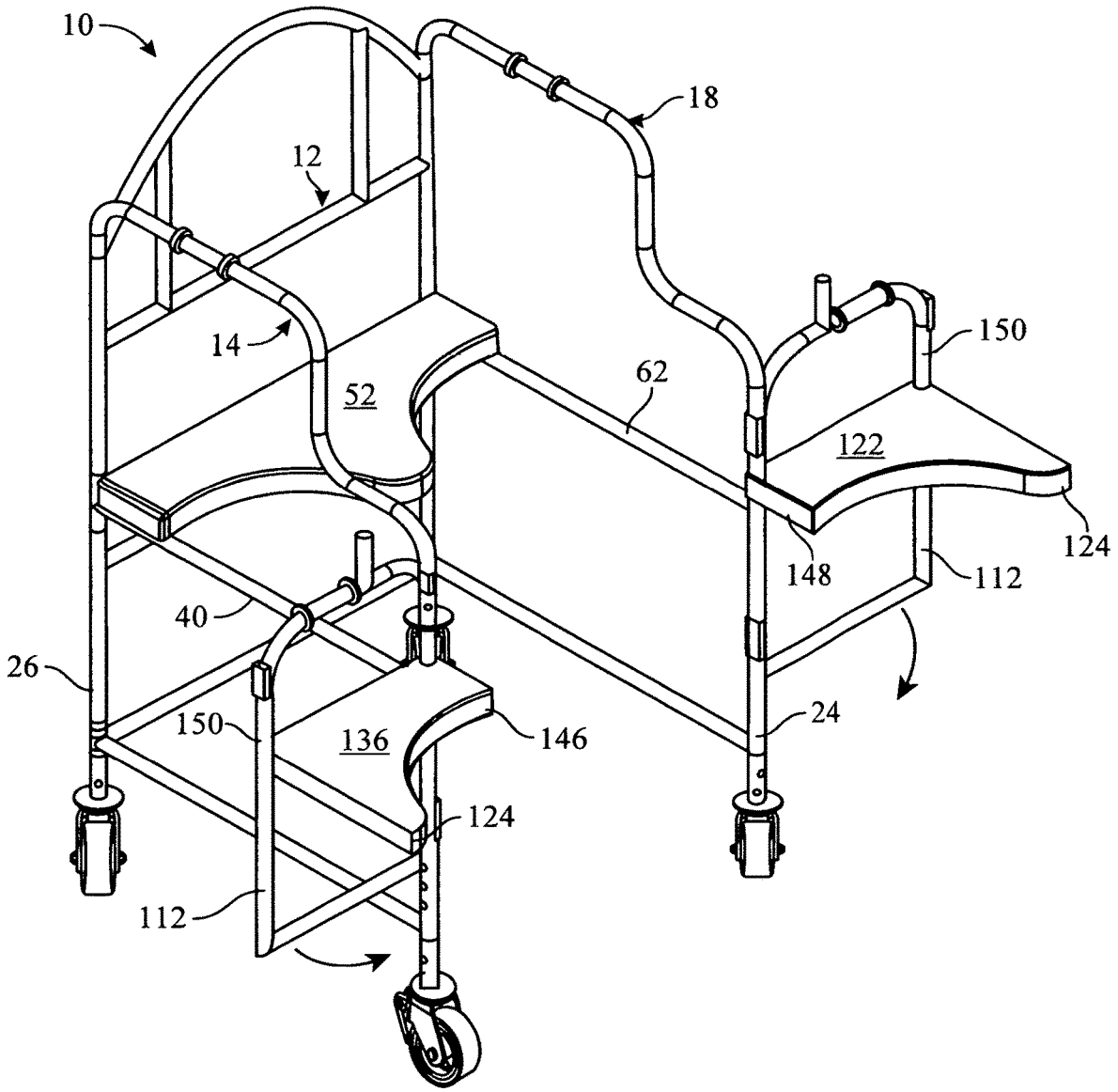
FIG. 4 is a perspective view of the walker assembly shown in FIG. 3 wherein the dual front gate portions have been swung open 180°.
Figure 5:
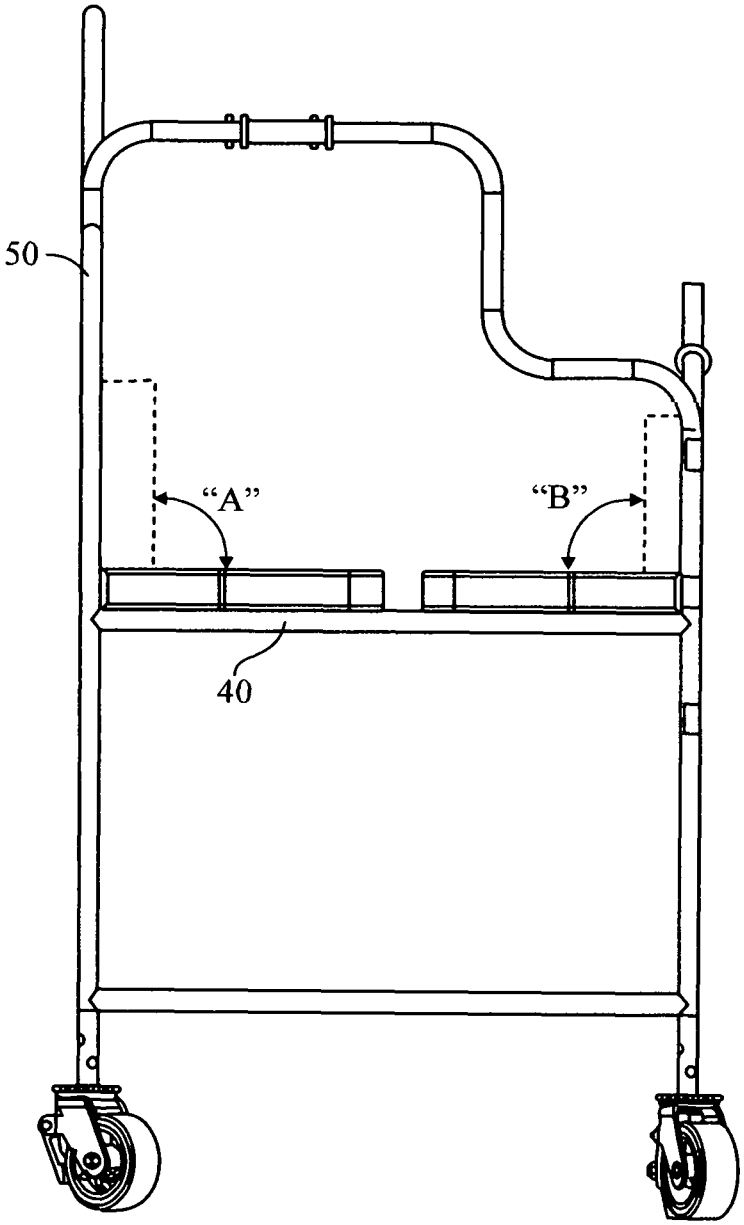
FIG. 5 is a side elevational view of the walker assembly shown in FIG. 1.

A further embodiment of the present invention is shown in FIGS. 3 and 4, wherein the invention includes the front side gate 112 which is split in half, having a split right side gate 114 pivotally connected by a plurality of hinges 116, to the right front column 24, and a split left side gate 118 pivotally connected by a plurality of hinges 120 to the left front column 38. The split right side gate 114 has a split right front seat 122, splitting the apex 124 of that curvilinear form at its midpoint. The split left side gate 118 has a split left front seat 136 splitting the apex 124 of the curvilinear form at its midpoint, comprising a mirror image of its adjacent split right side front seat 122, as may be seen in FIGS. 3 and 4. The split left front seat 136 and the split right front seat 122 are pivotable upwardly into a vertical orientation about a plurality of hinges 140 attached to a left gate truss 142 and a right gate truss 144 respectively, as indicated by arrows "U". The split left front seat 136 has a left edge 146 which rests upon the intermediate left side truss 40, as shown in FIG. 3 and the split right front seat 122 has a right edge 148 which rests upon the intermediate right side truss 62 as may be appreciated as in FIG. 4. The split left side gate 118 and the split right side gate 114 each have a latchable column 150 which are securely engageable with one another by a latch 152, when both gates 114 and 118 are closed.

Figure 6:
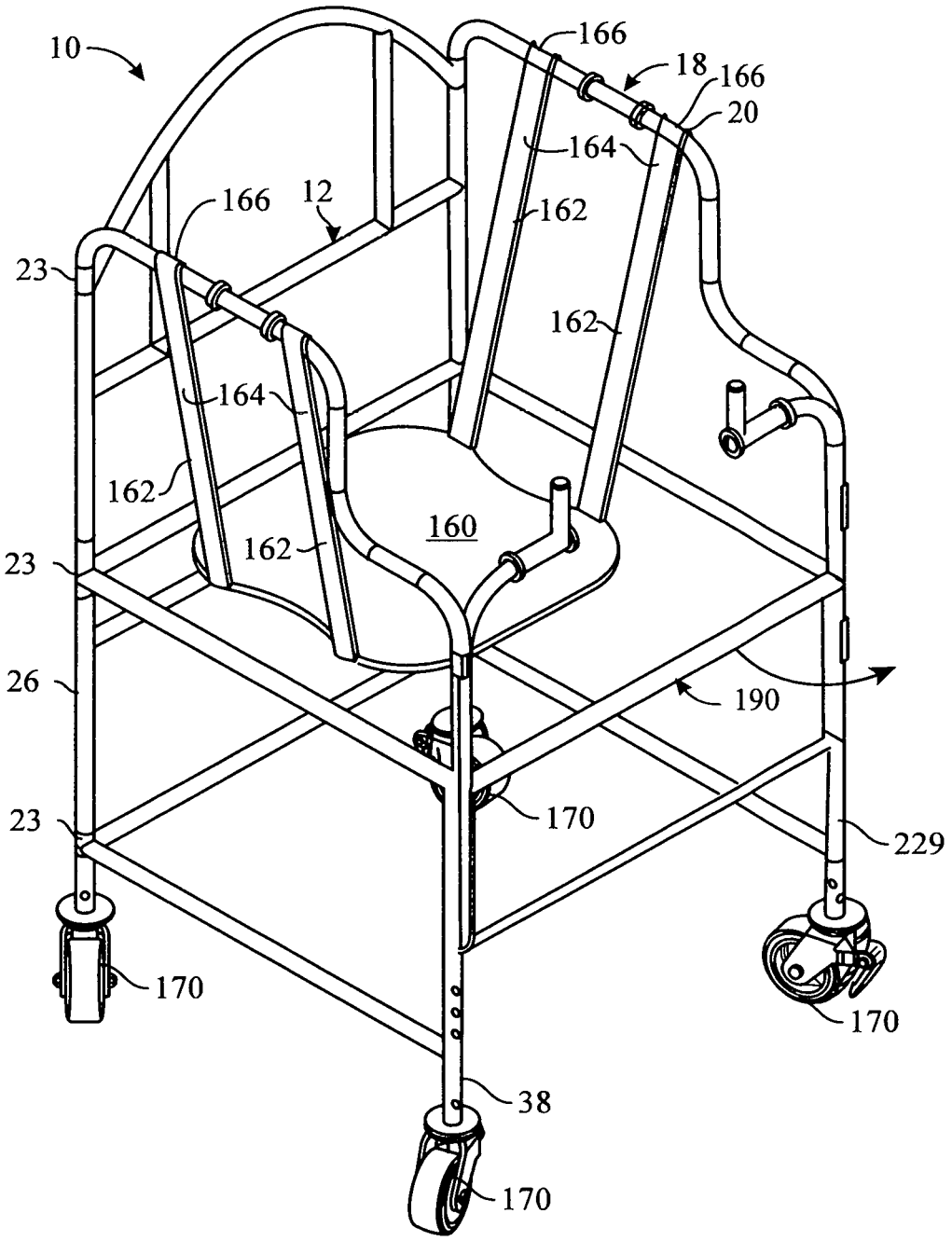
FIG. 6 is a perspective view of a further embodiment of the walker assembly showing a seat arrangement supported by a plurality of straps.
Figure 7:
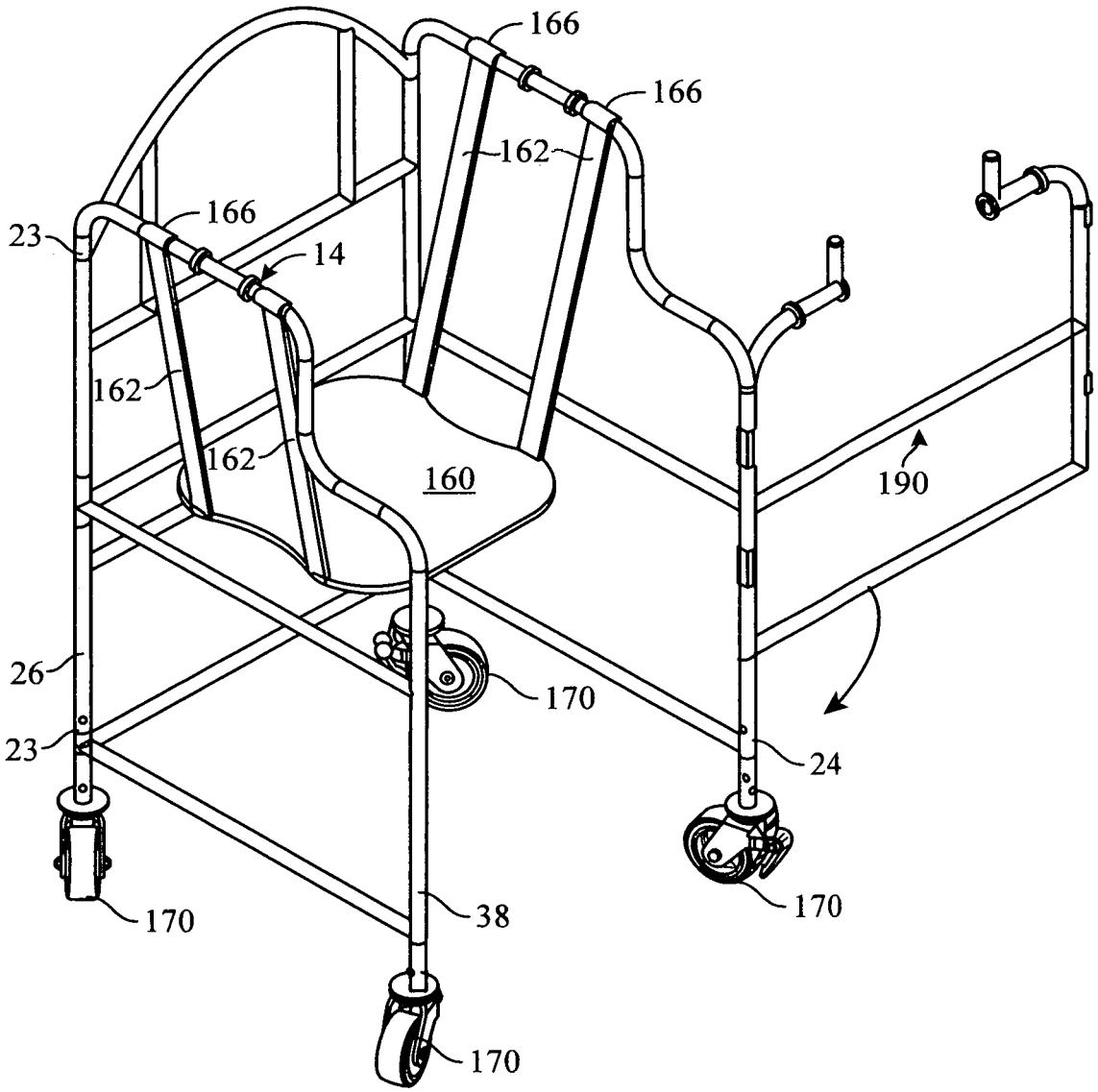
FIG. 7 is a perspective view of the further embodiment of the walker assembly shown in FIG. 6 wherein the front gate has been swung 180°.

A yet further embodiment of the present invention comprises a rigid seating 160 including a planar seat supported at each side thereof by a pair of flexible straps 162, each flexible strap 162 attached at its upper end to the uppermost frame portions 16 and 20 of the left side and right side respectively of the left frame side 14 and the right frame side 18, as shown in FIGS. 6 and 7. Each flexible strap 162 has its upper end 164 arranged through a wind/unwind ratchet 166 to accommodate changes as needed to the length of the particular strap.

Figure 8:
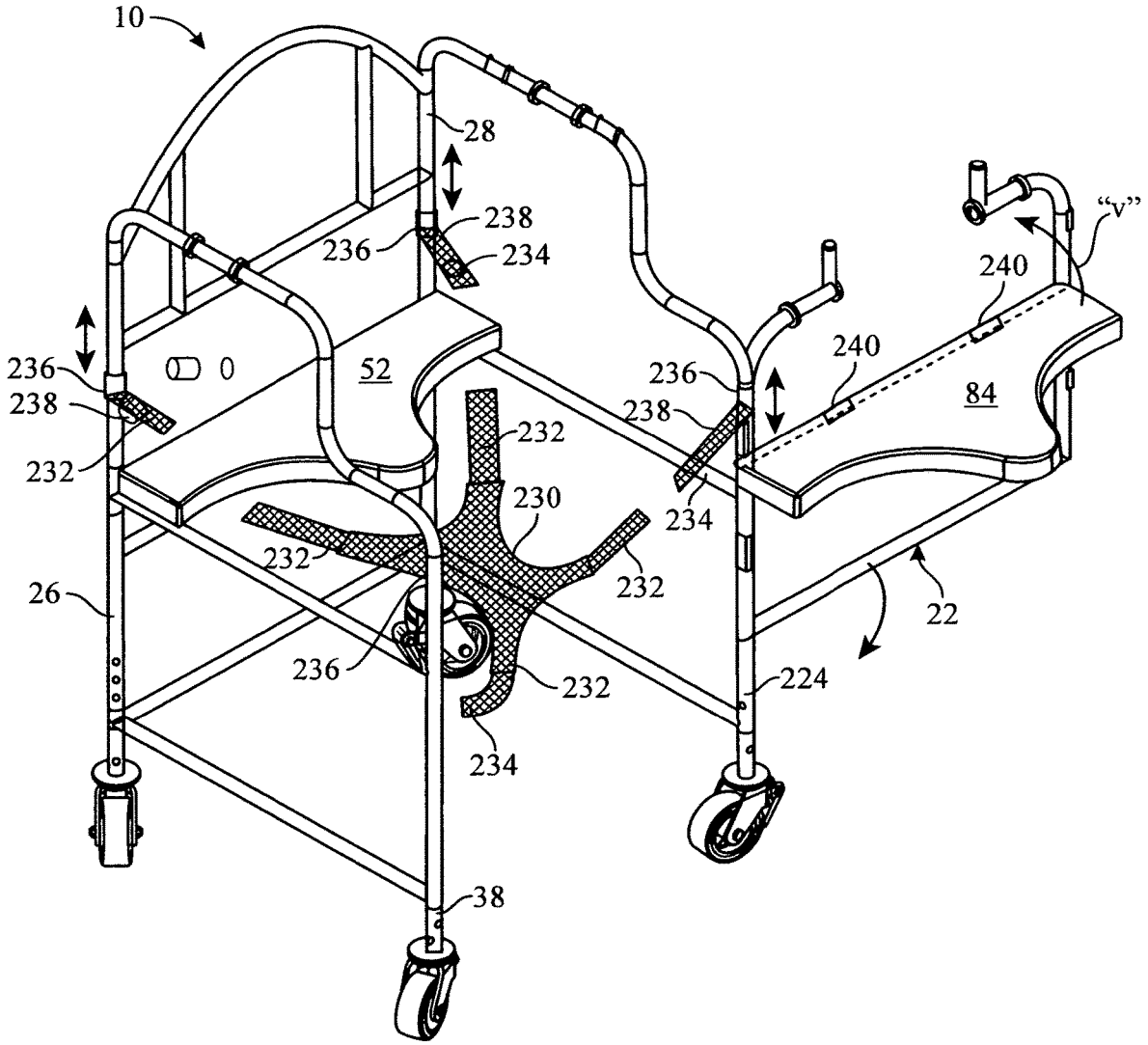
FIG. 8 is a perspective view of a further embodiment of the walker assembly shown in FIG. 1, wherein a height adjustable support pad is connectable to the corner columns enabling a supplemental support within the walker assembly.

A still further arrangement of the walker assembly 10 comprises a soft support embodiment as shown in FIG. 8, which includes a centrally supportive flexible web seat 230, of somewhat "X" shape, having four corners each of which have a flexible belt 232 connected thereto. Each belt 232 has a distal end with a clasp 234 thereattached. The right rear column 28 and the left rear column 26 each have a height adjustable clamp 236 thereon. The right front column 24 and the left front column 38 also each have an adjustable clamp 236 thereon. Each clamp 236 may include a belt length adjusting ratchet 238 to facilitate fine-tuning of the length of those belts 232. A user of the soft support embodiment of the present invention is able to attach one belt to the respective adjustable clamps on the right rear column 28 and the left rear column 26. That user of the soft support embodiment of the present invention will be able to rotate the rigid front seat 84 upwardly, as represented by the arrow "V", into a vertical out-of-the-way orientation and, once that user is within the confines of the walker assembly 10, attach the remaining two flexible belts 232 through the proper respective adjustable clamps 236 on the right front column 24 and the left front column 38. It is further contemplated that the rigid front seat 84 may be readily removable by lifting that rigid front seat 84 off of a releasable (bayonet style) hinge 240 arranged on the front side gate 22. This soft seat embodiment of the present invention thus provides the user the option of utilizing a pair of rigid front and back support seats 52 and 84 or no rigid support seats and just the flexible support web 230, or just the back rigid support seat 52 with the flexible support web seat 230.

A swivel wheel 170 is arranged at the lowermost end of the left rear column 26, the right rear column 28, the left front column 38 and the right front column 24, as shown in FIGS. 1, 2, 3, 4, 5 and 6. Entry into the walker assembly 10 is accomplished in a similar manner by the various embodiments discussed hereinabove. A walker user would face towards the gate once he/she were situated therewithin.

I claim:

1. A rectilinear walker assembly having a first or rear side, a second or left side, a third or right side, and a front gate side, each connected to a vertically adjustable corner column;

wherein the rear side has a rigid rear seat hingedly there-attached to permit the rigid rear seat to be moved from a horizontal orientation to a walker storable vertical orientation;

wherein the front gate side has a front rigid seat hingedly there-attached to permit the rigid front seat to be moved from a horizontal orientation to a walker storable vertical orientation; and wherein the rigid rear seat has a forwardly directed edge of sinusoidal configuration and wherein the rigid front seat has a rearwardly directed edge of sinusoidal configuration.

2. The rectilinear walker assembly as recited in claim 1 wherein the rearwardly directed edge of the rigid front seat and the forwardly directed edge of the rigid rear seat each have an apex on their sinusoidal edges which are spaced apart from one another when the rigid front seat and the rigid rear seat are in the horizontal orientation.

3. The rectilinear walker assembly as recited in claim 2 wherein the third or right side is hingedly connected to the first or rear side.

4. The rectilinear walker assembly as recited in claim 3, wherein the front gate side is split into a left side and a right side.

5. The rectilinear walker assembly as recited in claim 4, wherein the rigid front seat is split transversely at its apex.

6. The rectilinear walker assembly as recited in claim 2, wherein the sinusoidal front facing and sinusoidal rear facing seat configurations define a leg enclosing locus for receipt of a patient's legs on the respective opposite sides of the opposed apexes.

7. The rectilinear walker assembly as recited in claim 1 wherein the first or rear side and the second or left side are hingedly connected to one another.

8. The rectilinear walker assembly as recited in claim 7, wherein the front gate side is hingedly connected to the third or right side, to permit compact folding of the walker assembly.

9. The rectilinear walker assembly as recited in claim 1, wherein the left side and the right side each have intermediate side trusses extending between corner columns.

10. The rectilinear walker assembly as recited in claim 9, wherein each of the rigid front seat and the rigid rear seat have side edges which rest upon the intermediate side trusses when the rigid front seat and the rigid rear seat are in the horizontal orientation.

11. The rectilinear walker assembly as recited in claim 1, wherein the second or left side is foldable about a backside of the first or rear side, the third or right side is foldable about a front side of the first or rear side and the front gate side is folded about an outer side of the third or right side of the assembly.

12. The rectilinear walker assembly as recited in claim 1, wherein the front gate has a left column of "C" shape in cross-section arranged to closely engage and partially surround a left side front corner column.

13. A four sided mobile walker arrangement to enable the safe movable support and confinement of a handicapped patient therewithin, comprising:

a rearmost backside frame connected by an intermediate left rear column to a left side frame, and connected to a right side frame by an intermediate right rear column, the right side frame connected to a front side gate by an intermediate right front column;

a planar rear seat portion attached to an inner side of the rearmost backside frame and a planar front seat portion attached to an inner side of the front side gate, to define a rigid planar support to enable a patient within the mobile walker assembly to sit or stand there within;

wherein the planar rear seat portion is hingedly attached to an inner side of the rearmost backside frame to permit the planar rear seat portion to be moved from a horizontal orientation to a vertical orientation, and wherein the planar front seat portion is hingedly attached the front side gate to permit the planar front seat portion to be moved from a horizontal orientation to a vertical orientation, to enable the left side frame and the right side frame to be folded closely against the rearmost backside frame; and wherein the intermediate left rear column is hingedly connected to the left side frame, and the intermediate right rear column is hingedly connected to the right side frame, and is the intermediate right front column is hingedly connected to the front side gate.

14. The four sided mobile walker arrangement as recited in claim 13 wherein the planar rear seat portion has a frontmost facing edge in the shape of a sinusoidal wave, and the planar front seat portion has a rearmost facing edge in the shape of a sinusoidal wave.

15. The four sided mobile walker arrangement as recited in claim 14, wherein each sinusoidal wave has a centrally disposed apex, and each centrally disposed apex is spaced apart from one another when the planar rear seat portion and the planar front seat portion are in their horizontal orientations.

16. The four sided mobile walker arrangement as recited in claim 13, wherein the rearmost backside frame, the left side frame and the right side frame are constructed of intermating segments to enable dimensional replacement and thus size adjustability thereof.

* * * * *